US006021827A

United States Patent [19]

Gregor et al.

[11] Patent Number: 6,021,827

[45] Date of Patent: Feb. 8, 2000

[54] MACHINE FOR SURFACE WORKING OF WOOD WORKPIECES

[76] Inventors: Ledinek Gregor, Ul. Janka Serneca 47; Ledinek Pavel, Pivolska 31, both of 2000 Maribor, Slovenia

[21] Appl. No.: 09/063,308

[22] Filed: Apr. 13, 1998

[30] Foreign Application Priority Data

Sep. 26, 1997 [SI] Slovenia ..... 9700249
Jan. 7, 1998 [EP] European Pat. Off. ..... 98100133

[51] Int. Cl.[7] ..... B27L 11/00; B27C 1/00

[52] U.S. Cl. ..... 144/114.1; 144/118; 144/373; 409/139

[58] Field of Search ..... 144/114.1, 115, 144/118, 369, 373; 409/139, 140, 228

[56] References Cited

U.S. PATENT DOCUMENTS 4,690,186 9/1987 Chapman ..... 144/118
4,964,446 10/1990 Ledinek ..... 144/115

FOREIGN PATENT DOCUMENTS 39 09 019 C2 10/1990 Germany .

*Primary Examiner*—W. Donald Bray

*Attorney, Agent, or Firm*—McGlew and Tuttle, P.C.

[57] ABSTRACT

The machine for surface working of wood workpieces solves the problem of the quality wood workpieces working when passing over the working area of the working head, and when leaving it. The longitudinal central axis of the oblong static rotor, with therein fixed axes inserted and mounted, and front circular plates fixed onto it, is for the α angle staggered from the perpendicular to the front surface of the guiding plate in a way that the front circular plate is for the β angle staggered from the guiding plate front surface. The α angle and the β angle are preferentially of the same size, and their size changes inversely proportionally to the size of the outer diameter of the front circular plate, whereby the outer diameter of the rotor preferentially also represents its drive pulley at the same time. The cutting units are inserted into the toothed rim on the front circular plate in a way that the bearing body and the compression spring are vertically inserted into the vertical blind holes, and a wedge with a fixing element is inserted into the horizontally constructed blind holes. The small cutting plates are inserted into the bed on the bearing bodies in a way that in front view the cuffing edge forms a relief γ angle or in a way that in side view and in the front circular plate rotating direction the small cutting plate is inclined for a positive δ angle which represents the chip angle by the workpieces surface working.

12 Claims, 5 Drawing Sheets

DETAIL: "A"

DETAIL: "B"

MACHINE FOR SURFACE WORKING OF WOOD WORKPIECES

FIELD OF THE INVENTION

The invention relates to a machine for surface working of wood workpieces, or more precisely, a machine for working of wood with rotary tools, for surface working and working of wood workpieces on their thickness, or for surface straightening and lessening of thickness with the typical fixing of a cutting tool.

BACKGROUND OF THE INVENTION

According to the international patent classification this invention belongs to B 27/C 1/00 and additionally to B 27G 13/10.

By the European patent EP 0 382 877 the solution of a machine for surface working of primarily short and thin wood workpieces is known. According to this document the working or machining head is inserted between two plates for workpieces moving through, and placed on a rotary shaft wherein a guiding plate is inserted and fixed to one or both side guiding laths. The longitudinal axis of the rotary shaft is placed rectangularly on, or perpendicularly to, the entry and exit slide plates, and perpendicularly to the circular guiding insert, whereby the guiding surface is in the same plane as the slide surface of the exit slide plate. The deficiency or disadvantage of this known solution, respectively, is in the fact when the workpiece exits the working head area, the milling head blades notch into the exit edge or side of the workpiece and damage it. There is also a possibility that the workpiece gets stuck when it exits the milling head. A further disadvantage of this solution is the fact that it enables feeding or inclination of the circular guiding insert during the process of working, as it is clamped in two points only. Another disadvantage of this known solution is also in the fact that a considerable time is needed to stop the working head, because the working head does not enclose the braking machine. Furthermore the working head drive pulley is carried out separately and mounted to the rotary shaft.

By the German patent DE 39 09 019 a precise wood workpieces surface working machine solution is known. According to this document a rotating axis with an inner table or a guiding plate with its slide surface in the same plane as the outer table slide surface fixed to one end is linearly movably inserted into a hollow shaft. The rotor with knives is fixed to the rotary shaft and to the support over an intermediate clamping plate, whereas A pulley for driving the rotary shaft is placed at the other end of the rotary shaft from the knives. The knives are placed on the rotor front rim by a negative angle with respect to the rotor rotating axis. The deficiency or disadvantage of this known solution is in the fact that the negative cutting angle does not enable quality working and removal of cuttings, and when the workpiece exits, the knives notch into the exit edge or side of the workpiece and damage the workpiece. There is also a danger that the workpiece gets stuck when leaving the working head area. A further disadvantage of this document is that the slit between the outer edge of the inner table and the outer entry and exit table edge is too large due to the length of the cutting knives which does not allow surface working of very short and thin wood workpieces, and also in the fact that the rotor does not have any braking system, and the drive pulley is carried out separately and placed onto the hollow shaft. The next disadvantage of this known solution is also in the fact that the axis of the inner table is movable in the vertical direction and mounted into the hollow shaft, which does not ensure the necessary rigidity and stability needed during working. The problem that has remained unsolved is primarily how to ensure a quality working of workpieces when the workpieces exit from the working head area, and to prevent the workpieces from getting stuck. Furthermore, the problem exists also in simplifying a quite complicated working head drive construction, in accelerating braking, as well as in the insertion and adjustment of the actual cutting tools.

SUMMARY AND OBJECTS OF THE INVENTION

The primary technical problem solved by this invention is a construction of an appliance that will allow quality precision working of surfaces of wood workpieces on the whole surface, also when the workpiece exits the working area. Furthermore is another object to allow simple insertion and exact adjustments of cutting units into the toothed rim of the working head, equipped with a direct drive and a brake mechanism. This solution does not include the methods of inserting, adjusting and clamping the cutting tools.

By this invention the problem is solved by in a machine for surface working of wood workpieces where the rotor has inserted in it a fixed axis which is staggered or angularly spaced by an angle $\alpha$ from the axis perpendicular to the entry plate and the exit plate. The rotor is also staggered from a normal or perpendicular line to the guiding plate by the same $\alpha$ angle. In this way the circular plate front surface, where a toothed rim with cutting units is fixed, is placed at an angle $\beta$ to the planes of the entry and exit plate sliding surfaces, and likewise to the plane of the guiding plate front surface. The circular plate front surface and the exit plate sliding surface thus enclose angle $\beta$, what is equally valid for the ratio between the circular plate front surface and the guiding plate front surface. The front circular plate is fixed to an end of the rotor where the fixed axis is inserted into the rotor. The fixed axis has one end fixed within the machine housing, and the guiding plate is steadily clamped to the opposite end of the fixed axis. On the machine housing side of the rotor, a mechanical brake for braking the working head is fixed to the rotor. The invention will be more precisely described in two priority embodiments which follow.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
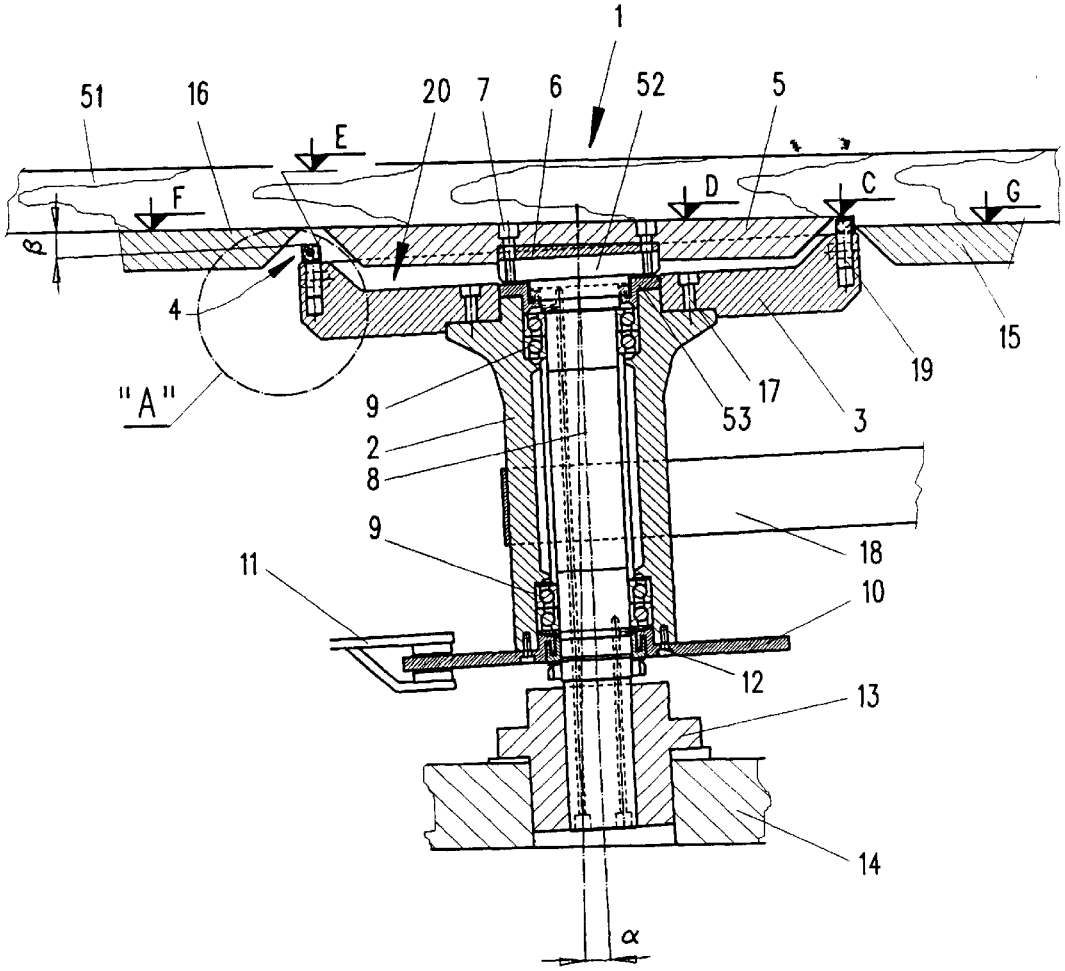
FIG. 1 is a view of a first embodiment of the machine according to the invention in the longitudinal section.

Referring to the drawings, and especially to FIG. 1, the machine for surface working of wood workpieces is constructed of a working head 1 with a front circular plate 3 and a toothed rim 4, a rotor 2, a guiding plate 5, a fixed axis 8, a brake disc 10 with a mechanical brake 11, as well as an entry plate 15 and an exit plate 16. These elements are present in both the first embodiment of FIG. 1, as well as in the second embodiment with FIG. 2. In both embodiments the working head 1 is placed into the opening between the vertical movable entry plate 15 and the fixed exit plate 16.

In the first embodiment, presented in FIG. 1, the working head 1 is made up of a vertically placed hollow rotor 2, which has at one of its ends a circular plate 3 with a toothed rim 4 and an unmarked hole in the middle. The toothed rim 4 is fixed by fixing elements 17. At the other end of the rotor 2 is a brake disc 10 with a mechanical brake 11. The brake disc is fixed by fixing elements 12. The front circular plate 3 is set out onto a specially worked out bed on the outer rim of the hollow rotor 2 through an unmarked hole in the middle in a way that by the toothed rim 4 or the cutting units 19 respectively, it is turned to the plates 15 and 16. On the side of the cutting units 19 there is a circular deepening, recess or depression 20 carried out, or formed into, into the circular plate 3 front surface.

Into, or through, the rotor 2 respectively the fixed axis or shaft 8 is placed in a way that on the side of the front circular plate 3 with a hub 52 it is put on its front surface over an intermediate sealing ring 53, and on the side of the brake disc 10 it reaches a bit outside the rotor 2.

On the axis or shaft 8 there is a hub 52 with a front surface. An intermediate small spacing plate 6 is placed on the front surface of hub 52. The guiding plate 5 of a circular form is placed and fixed by fixing elements 7 through spacing plate 6 in three points to the fixed axis 8, as well as to two side guiding laths, not shown. The small spacing plate 6 has a wedge structured transverse section, and is inserted into an unmarked depressed bed on the guiding plate 5 dorsal side.

Between the outer circumference of the fixed axis or shaft 8 and the circumference of the hole through the rotor 2 there are inserted roller bearings 9 in a tight fit in such a way that the rotor 2 represents their housing.

The fixed axis 8 exit part or end is fixed and steadily clamped to the machine housing 14 on the fixed brake disc 10 side by an intermediate clamping bush 13.

The fixed or static coupling of the first priority embodiment with FIG. 1 is constructed of a fixed axis 8 with a guiding plate 5 and a small spacing plate 6, both of them fixed to one end of the hub 52 and with the clamping box 13, in the housing 14, at its other end.

The rotating coupling of the embodiment with FIG. 1 is constructed of a rotor 2 with the front circular plate 3 and a toothed rim 4 at one end, and a brake disc 10 at the other end. The rotating coupling is driven by an undescribed and not shown driving unit, through an intermediate driving belt 18, placed on the outer circumference of the rotor 2 which is at the same time also the pulley of this coupling.

The working head 1 of the embodiment of the machine for surface working of wood workpieces, according to the invention from FIG. 1, is placed in the opening between the entry plate 15 and the exit plate 16 in such a way that the outer edges C of the cutting units 19 lie in the opening between the edge of the entry plate 15 and the edge of the guiding plate 5, in the same plane or a bit above the surfaces D of the guiding plate 5, and F of the exit plate 16. The surfaces D and F lie constantly in the same plane. The outer edges E of the cutting units 19, in the opening between the edge of the guiding plate 5 and between the edge of the exit plate 16 and surfaces G of the entry plate 15, there lie constantly a bit lower than the plane of the surfaces D and F. Furthermore, the working head 1 in this embodiment is placed between the plates 15 and 16 in such a way that the common longitudinal central axis of the rotor 2, of the front circular plate 3 and of the fixed axis 8 is shifted by the angle $\alpha$ from the fictive or imaginary vertical to the front surfaces D, F and G, as regards, or with respect to, the entry plate 15. Thus the longitudinal central axis of the front circular plate 3 is also shifted for by the $\alpha$ angle from the horizontal surface D of the guiding plate 5, which is true also for the angled shift of the edge E as regards the edge C of the cutting units 19 in the position shown in FIG. 1. In this case the rule applies that in all cases the $\alpha$ angle equals the $\beta$ angle and vice versa, whereby their size depends on the outer diameter of the working head 1, or on the front circular plate 3, and is inversely proportional to it. In case of a larger diameter of the circular plate 3, the $\alpha$ and $\beta$ angles are smaller, and if the diameter of the circular plate 3 is smaller, the $\alpha$ and $\beta$ angles are larger. This means that the width of working of workpieces 51 depends on the size of the outer diameter of the front circular plate 3 and the guiding plate 5 placed into it, as well as on the distance between side laths, which are both not shown and not indicated, placed above the working head 1.

The procedure of surface working the workpieces 51, or the procedure of their working to an optional thickness, starts by adjusting the thickness of cutting. This is adjusted by the vertical movable entry plate 15 and it represents the height difference between the edge C on the cutting units 19 and the surface G of the entry plate 15. The rotor 2 is rotated, together with the front circular plate 3 by the driving unit via the driving belt 18. The workpiece 51 moves along the surface G of the entry plate 15 to the edge C of the cutting units 19, and during its movement over the cutting units 19 there is removal of the surface of the workpiece 51. The workpiece 51, or the surface D of the guiding plate 5 is pressed down by not shown and undescribed press feeding instruments. As was previously described the surface working of the workpiece 51 is carried out on the entry half of the diameter of the front circular plate 3. When the workpiece 51 is leaving the surface D of the guiding plate 5, the workpiece 51 slides above the edge E of the cutting units 19, and it passes over to the surface F of the exit plate 16. In this way the cutting units 19, between the edges of the guiding plate 5 and the exit plate 16 or their edges E, do not damage the workpiece 51 when it is leaving the area of the working head 1. At the same time it is prevented that the workpiece 51, primarily of smaller dimensions, due to a small aperture, get stuck between the joint edges of the guiding plate 5 and the exit table 16. According to the invention, after working is finished, the machine is stopped by means of a mechanical brake 11, which presses with its jaw against the brake disc 10.

By another embodiment of the machine 1, the front surface of the hub 52 of the fixed axis 8 can also be constructed for an angle whereby the construction of the intermediate small spacing plate 6 is omitted. Also the rotor 2, the front circular plate 3, the toothed rim 4, the guiding plate 5, the fixed axis 8 and its fixture into the housing of the machine 14, as well as the brake disc 10 with the brake 11, can be constructed differently.

Figure 3:
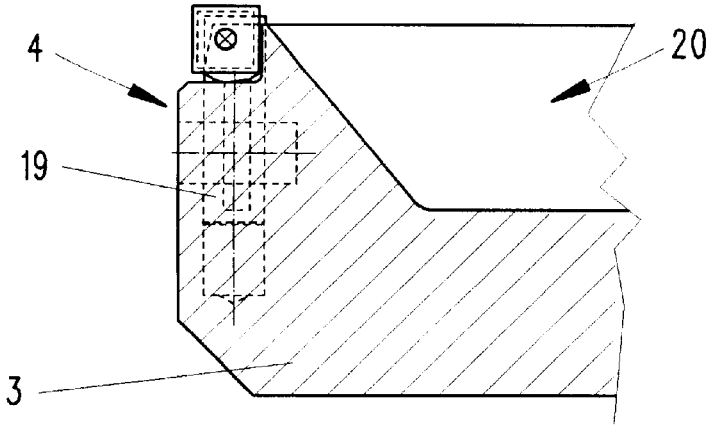
FIG. 3 is a view of detail A in FIG. 1.
Figure 5:
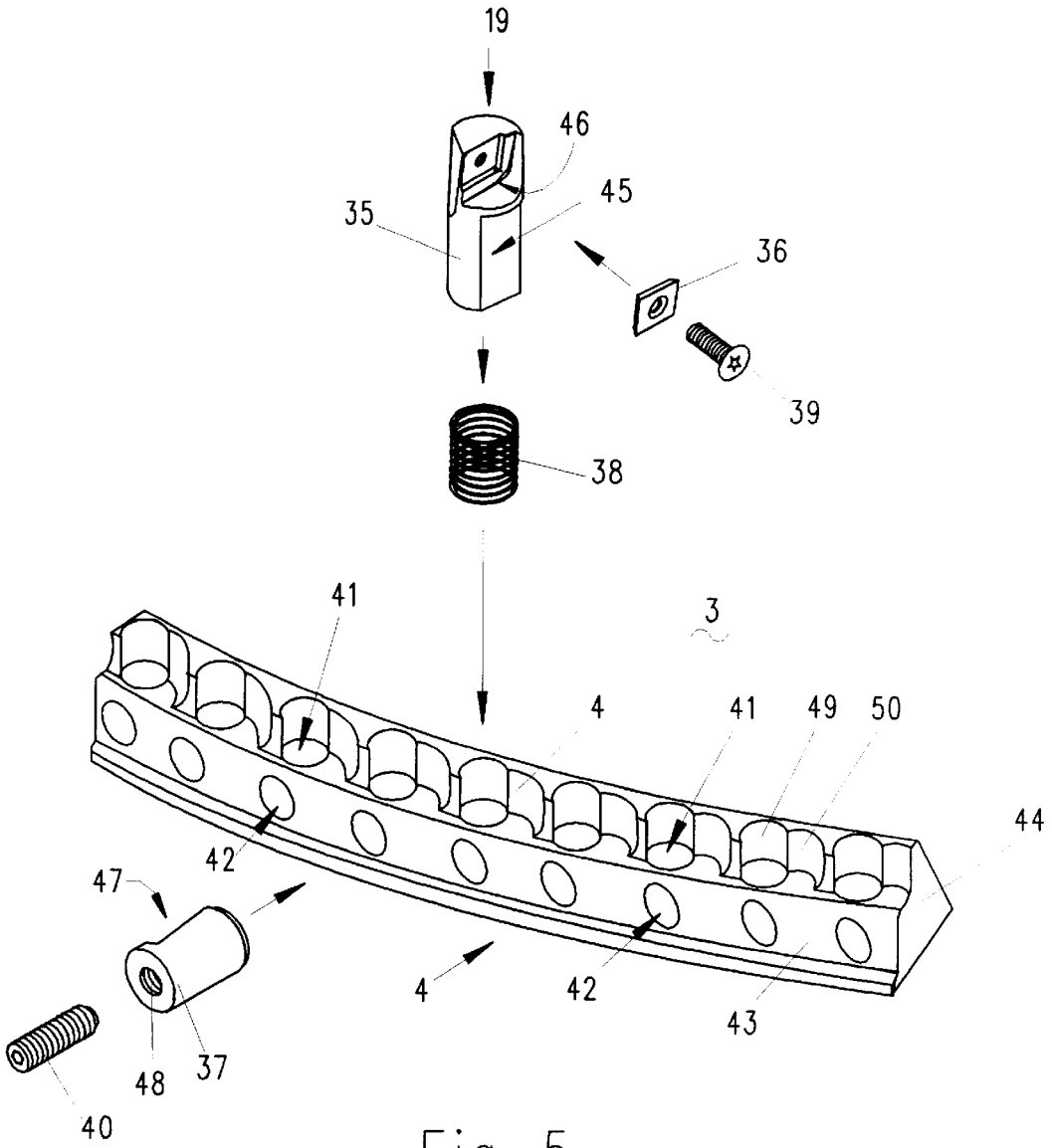
FIG. 5 is a schematic presentation of the working head toothed rim structure in perspective.

In FIG. 3 there is shown a toothed rim 4 which is constructed on the whole circumference of the front circular plate 3 with the same circular deepening or recess 20 presented in one piece, and has on the whole circumference interchangeably inserted or placed cutting units 19. The insertion and adjustment of the cutting units 19 in the toothed rim 4 of the front circular plate 3 is shown in FIG. 5. The individual cutting units 19 are made up of a cylindrical bearing body 35 with a straight surface 45 and a bed 46 skimmed at one side, and is constructed of a cutting plate 36, wedge 37 with a bevel 47 on the outer coat, and with a centered hole 48 with an inner thread, and is further constructed of a compression spring 38, fixing element 39 and fixing element 40.

The individual cutting unit 19 is inserted into the toothed rim 4 of the front circular plate 3 in such a way that the compression spring 38 is at first placed into the vertical blind hole 41, and the wedge 37 with the fixing element 40 is inserted into the horizontal blind hole 42. Then the bearing body 35 with the small cutting plate 36, fixed with a fixing element 39, is placed on the compression spring 38. The bearing body 35 is inserted into the hole 41 in such a way that its straight surface 45 lies in the direction as regards the center of the front circular plate 3, and rests next to or on the surface 47 of the wedge 37.

The bearing body 35 with the small cutting plate 36 is adjusted to a certain height by feeding the compression spring 38 and is fixed in such a way that by tightening up the fixing element 40 the inclined surface 47 on the wedge 37 is stretched against the straight surface 45 on the bearing body 35, and thus it is steadily made fixed in the toothed rim 4. Radial deepenings 49 allow in this case a larger inclination of cutting units 19 in the toothed rim 4, and the adjacent radial deepenings 50 enable undisturbed removal of chips.

Figure 6:
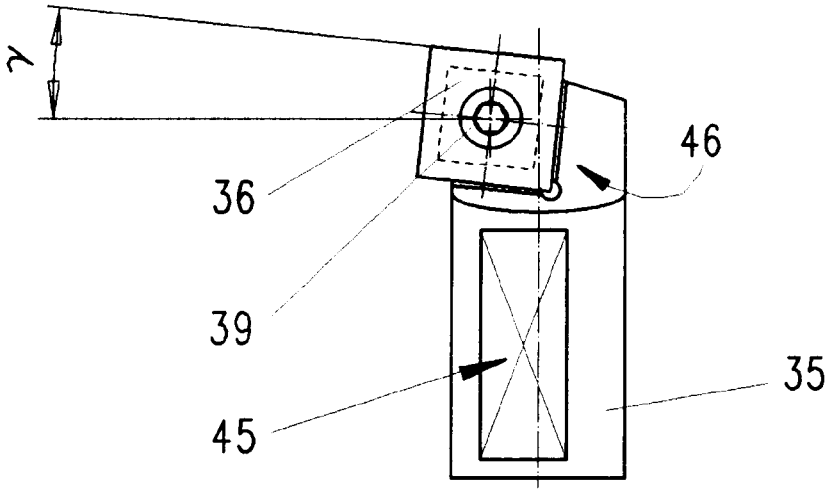
FIG. 6 is a schematic presentation of the small cutting plate for the relief angle adjustment in front view.

The small cutting plates 36 are inserted into the bed 46, on the bearing body 35 and fixed with the fixing element 39 in such a way-that in front view their upper cutting edge lies at the angle $\gamma$, or their cutting edge is for that relief angle inclined from the fictive horizontal axis, which is presented in FIG. 6. The small cutting plates 36 can be of optional regular or irregular geometrical forms.

Figure 7:
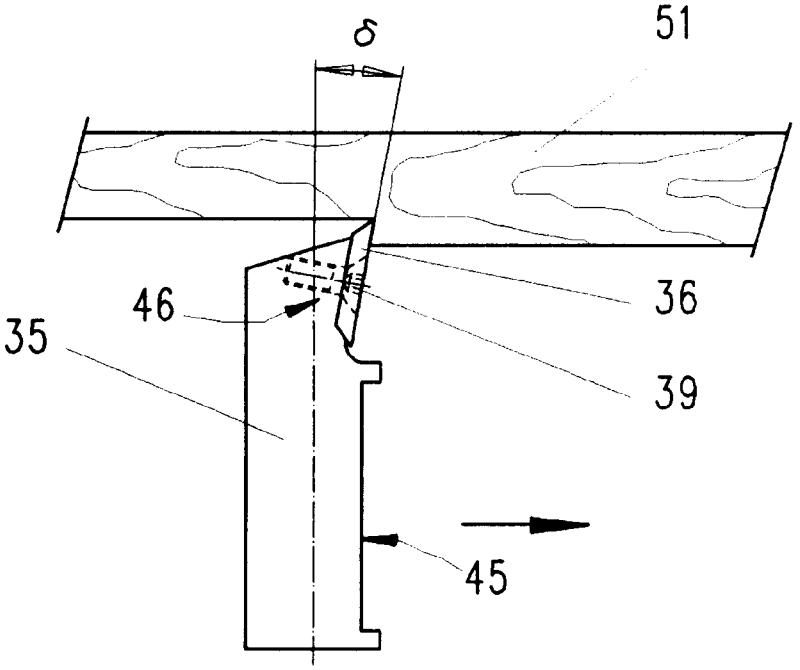
FIG. 7 is a schematic representation of the chip positive angle, or the small cutting plate adjustment respectively, in side view.

In FIG. 7 the bearing body 35 with a fixed small cutting plate 36 is shown in a side view. It is evident from it that the bed 46 on the bearing body 35 is constructed for the positive $\delta$ angle, and for the same angle also the small cutting plate 36 is fixed in it, where the small cutting plate 36 and the straight surface 45 are, with the front, larger surface, turned in the direction of rotation of the front circular plate 3, or its toothed rim 4. The positive $\delta$ angle of the inclination of the small cutting plate 36 from the longitudinal central axis of the bearing body 35 represents the angle of the chip, which is cut by the individual small cutting plate 36 of each cutting unit 19 on the toothed rim 4 of the front circular plate 3, on the side of the surface working of the workpiece 51.

Figure 2:
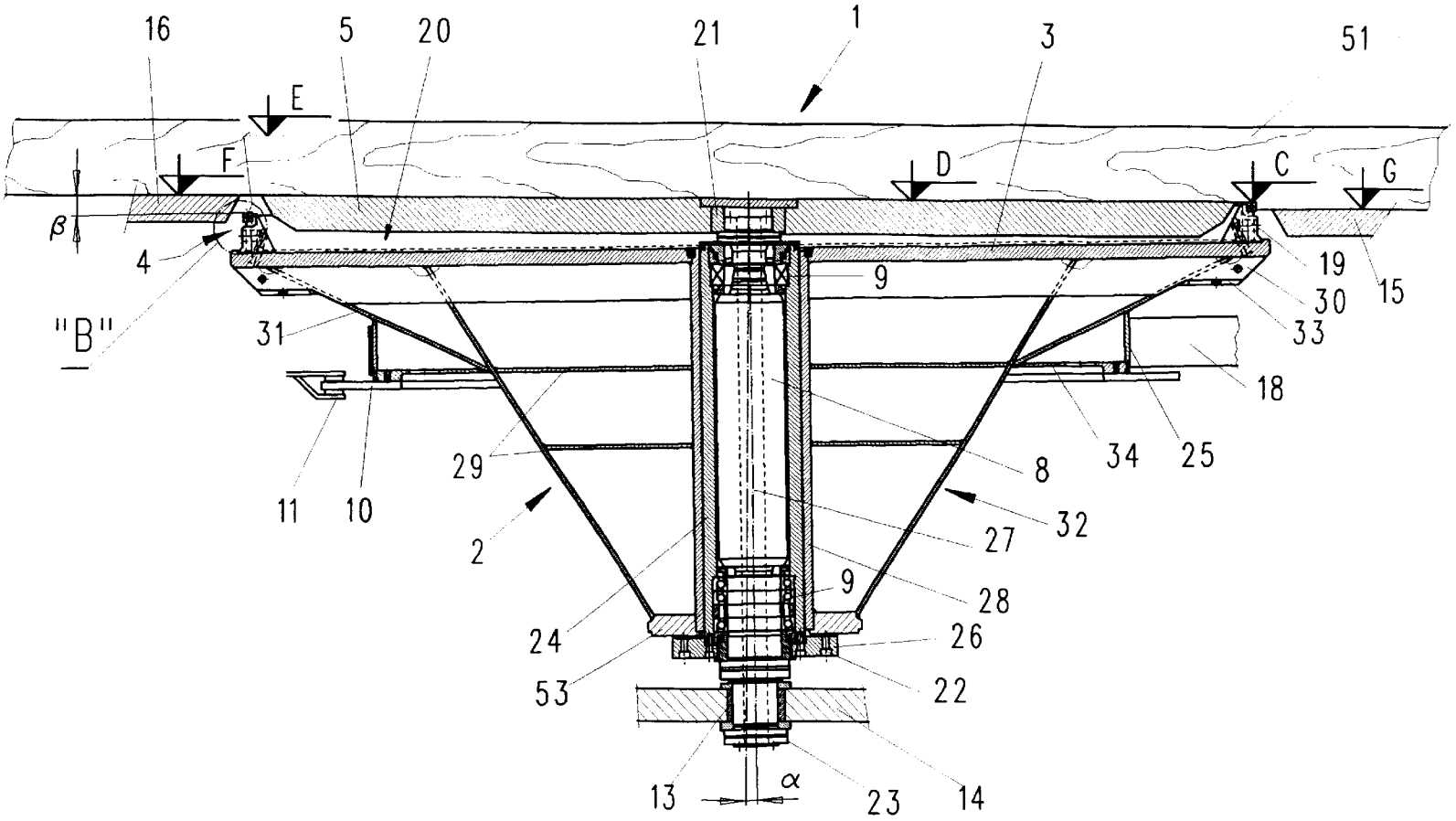
FIG. 2 is a view of a second embodiment of the machine according to the invention in the longitudinal section.

In the second embodiment, presented in FIG. 2, the working head 1 is constructed of a vertically placed rotor 2, of a welded construction and a "V" form, which has at the wider end of the hewn hollow cone 32 a steadily fixed front circular plate 3 with a toothed rim 4 and a vertical, on both sides open hollow tube 28 in the center, and to its other end there is a steadily fixed plate 53. The hollow tube 28 is conducted through the rotor 2, the front circular plate 3 and the plate 53, and it is primarily of the same length as the described coupling. The hewn hollow cone 32 and the front circular plate 3 are on the whole circumference surrounded by a fixed hewn hollow cone 31, and the rotor 2 is additionally strengthened by an inner ring 29, an outer rib 30, an outer ring 33 and an intermediate ring 34. To the intermediate ring 34 there are also fixed the brake disc 10 with the mechanical brake 11 and the pulley 25. The front circular plate 3 is placed between the vertical movable entry plate 15 and the fixed exit plate 16 in such a way that it is turned to them with the toothed rim 4 or the cutting units 19. The toothed rim 4 and the front surface of the circular plate 3 form a deepening or recess 20, also of a circular form.

Into the tube 28 of the rotor 2 there is in a tight fit placed a hollow housing 24, through which a fixed axis 8 with a lubricating channel 27 is inserted, and between them there are tightly fit roller bearings 9. On the side of the circular plate 3, at the end of the fixed axis 8, is by means of a clamping insert 21 steadily fixed the guiding plate 5, of a circular form, whereas with the other end the axis 8 is steadily clamped into the housing of the machine 14, by means of a clamping box 13 and a fixing element 23. Between the housing 14 and the cone 32 a fixing ring 26 with fixing elements 22 is fixed to the plate 53. In another embodiment of the described example of FIG. 2, the rotor 2 can be of different construction.

The fixed or static coupling of the second priority embodiment from FIG. 2 is constructed of a fixed axis 8 with a guiding plate 5 and an insert 21 at one end, and with a clamping bush 13 in the housing 14, at the other end.

The rotating coupling of the embodiment from FIG. 2 is constructed of a rotor 2 with a front circular plate 3 and a toothed rim 4, a brake disc 10 and a pulley 25 fixed to it, as well as the housing 24 of bearings 9. The rotating coupling is driven by an undescribed and not shown driving unit over a driving belt 18 which entwines the pulley 25 on the rotor 2.

The working head 1 of the embodiment of the machine for surface working of wood workpieces, according to the invention from FIG. 2 is placed into the opening between the entry plate 15 and the exit plate 16 in such a way that the outer edges C of the cutting units 19 lie between the edges of the entry plate 15 and the guiding plate 5, in the same plane, or a bit above the surfaces D of the guiding plate 5 and F of the exit plate 16, whereby the surfaces D and F lie constantly in the same plane. The outer edges E of the cutting units 19, in the opening between the edge of the guiding plate 5 and between the edge of the exit plate 16, as well as the surface G of the entry plate 15 lie constantly a bit lower that the plane of the surfaces D and F. Furthermore, the working head 1 in this embodiment is placed between the plates 15 and 16 in such a way that the common central axis of the rotor 2, of the front circular plate 3 and of the fixed axis 8 is shifted for the angle a from the fictive vertical to the front surfaces D, F and G, in the direction as regards the entry plate 15. In this way the longitudinal central axis of the front circular plate 3 is also shifted in the same direction for the angle $\beta$ from the horizontal surface D of the guiding plate 5, which is equally valid for the angled shift of the edges E as regards the edges C of the cutting units 19, in position shown in FIG. 2. In this case the rule applies described already in the embodiment from FIG. 1, which means that in all cases the angle $\alpha$=angle $\beta$ and vice versa, and where the size of these two angles depends on the outer diameter of the working head 1, or the front circular plate 3, or the size of the angles $\alpha$ and $\beta$ is inversely proportional to the diameter of the front circular plate 3. The larger is the diameter of the front circular plate 3, the smaller are the angles $\alpha$ and $\beta$, and the larger are the angles, the smaller is the diameter of the front circular plate 3. At the same time this means that the width of working of workpieces 51 depends on the size of the outer diameter of the front circular plate 3 and the guiding plate 5 placed into it, and it also depends on the spacing between both side laths, not shown, placed above the working head.

The procedure of the surface working of workpieces 51 with the machine, according to the second embodiment in FIG. 2, equals the previously described procedure of working with the machine according to the first embodiment in FIG. 1.

Figure 4:
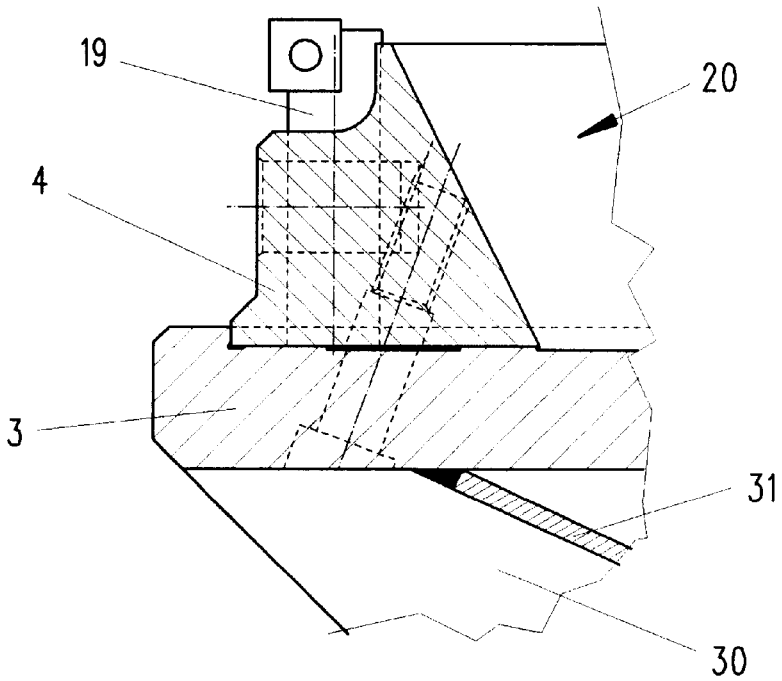
FIG. 4 is a view of detail A in FIG. 1.

In FIG. 4 the toothed rim 4 is presented, made in a separate piece, which is welded or fixed in another way to the front circular plate 3, in such a way that it is constructed on the entire circumference of the plate and together with the plate it forms a circular deepening 20. The toothed rim 4 has on its entire circumference interchangeably inserted cutting units 19. The method of inserting, taking off and adjusting the cutting units 19 into the toothed rim 4 of the front circular plate 3 is presented in FIG. 5 and it equals the previous description in the first embodiment in FIG. 1. The latter is equally valid for the previously described adjustment of small cutting plates 36 into the bed on the bearing body 35 of the cutting units 19, presented in FIG. 6 and FIG. 7.

The solid construction of the rotor 2 and the fixed or rigid connection of the fixed axis 8 with the guiding plate 5 allow larger diameters of the front circular plates 3 and of the guiding plates 5 placed into them, and consequently also larger working widths.

While specific embodiments of the invention have been shown and described in detail to illustrate the application of the principles of the invention, it will be understood that the invention may be embodied otherwise without departing from such principles.

We claim:

1. The machine for surface working of wood workpieces, in which the working head with the circular guiding plate is placed into the circular opening between the vertically adjustable entry and the fixed exit plate, and which is constructed of a vertical, hollow rotor, supporting the front circular plate with the toothed rim, and of the, into the rotor placed, fixed axis, onto which there is also steadily fixed a circular guiding plate, placed within the circular deepening in the front circular plate, or within its toothed rim in such a way that the front surface of the guiding plate lies in the same plane as the slide front surface of the exit plate, and is at the same time parallel to the slide front surface of the entry plate, is characterized by the fact that the longitudinal fixed axis symmetry, and placed there upon a rotating rotor, for a sharp $\alpha$ angle inclined from its fictive perpendicular to the guiding plate front sliding surface, whereby the front circular plate with a toothed rim which is fixed to one rotor end is thus placed for the $\beta$ angle inclined to the plane which is formed by the guiding and exit plate front sliding surfaces; that the cutting units cutting edges are placed in the circular plate toothed rim which are placed in the area between the guiding plate and exit plate edges, a bit lower than the cutting units cutting edges which are placed in the area between the guiding plate and exit plate edges, whereby the plane wherein the cutting edges are placed, together with the exit plate front sliding surface plane enclose the interactive angle $\beta$; that each individual cutting unit is inserted into the circular toothed rim at the circular plate front side in the way that there are one upon another a compression spring and a cylindrical bearing body inserted into the vertical blind hole, while into the horizontal, perpendicular to it constructed blind hole there is inserted a cylindrical wedge which is put on by its inclined plane beside or on the straight plane, constructed on the bearing body coat, somehow below the small cutting plate.

2. According to the claim 1 the machine is characterized by the fact that the $\alpha$ angle and the $\beta$ angle are primarily of the same size, and their size is inversely proportional to the size of the outer diameter of the front circular plate.

3. According to the claim 1 the machine is characterized by the fact that the outer circumference of the rotor is simultaneously the pulley for the front circular plate drive.

4. According to the claim 1 the machine is characterized by the fact that a brake disc with a mechanical brake of an optional structure is steadily fixed to the rotor by fixing elements.

5. According to the claim 1 the machine is characterized by the fact that into the deepened bed on the cutting unit bearing body there is inserted, and by a fixing element a small cutting unit there is steadily fixed in a way that in front view its upper cutting edge is inclined for the relief $\gamma$ angle from its fictive perpendicular to the bearing body longitudinal central axis, whereby its larger front surface in side view and in the front circular plate rotating direction for the positive $\delta$ angle is staggered from the bearing body longitudinal axis, whereby the positive $\delta$ angle represents the chip angle.

6. A device for surface working of workpieces, the machine comprising:

a rotor defining a hollow and including a circular plate with a toothed rim, said circular plate and said rim defining a recess, said rotor being rotatable about a rotation axis;

a fixed shaft positioned in said hollow of said rotor;

a guiding plate with a slide surface, said guiding plate being connected to said fixed shaft and positioned in said recess of said rotor;

an entry plate with a slide surface positioned adjacent an upstream side of said rotor, said rotation axis of said rotor being angularly spaced from an axis perpendicular to said slide surfaces of said guide plate, said rotor being positioned to have an upstream portion of said rim positioned away from said sliding surface of said entry plate in a first direction, said rotor being positioned to have a downstream portion of said rim positioned away from said sliding surface of said guiding plate in a second direction, said first and second directions being substantially opposite.

7. A device in accordance with claim 6, wherein:

said fixed shaft is substantially parallel with said rotation axis of said rotor;

an exit plate is positioned adjacent a downstream side of said rotor, said exit plate having a slide surface in a substantially same plane as said sliding surface of said guiding plate and substantially parallel to said sliding surface of said entry plate.

8. A device in accordance with claim 6, wherein:

said entry plate is movably adjustable in a direction substantially perpendicular to said sliding surface of said entry plate with respect to said rim of said rotor;

said rotor rotates on said fixed shaft about said rotation axis, said rotational axis being inclined at a sharp $\alpha$ angle from a perpendicular to sliding surface of said guiding plate, whereby the circular plate with said toothed rim is inclined at an angle $\beta$ to said plane which is formed by said guiding and exit plate sliding surfaces;

cutting units with cutting edges are placed in said toothed rim, said rotor is positioned to have said cutting units placed in an area between said guiding plate and exit plate edges, a bit lower than said cutting units cutting edges which are placed in an area between said guiding plate and said entry plate, whereby the plane wherein the cutting edges are placed, together with the exit plate front sliding surface plane enclose said interactive angle β.

9. A device in accordance with claim 6, wherein:

cutting units with cutting edges are placed in said toothed rim, each said individual cutting unit is inserted into said toothed rim at an edge of said circular plate with a compression spring and a cylindrical bearing body inserted into a vertical blind hole, while a cylindrical wedge is inserted into a horizontal blind hole, said cylindrical wedge is put on by its inclined plane beside or on the straight plane, constructed on the bearing body coat, somehow below the small cutting plate.

10. A device in accordance with claim 8, wherein:

said α angle and said β angle are substantially equal, a magnitude of said angles is inversely proportional to a size of an outer diameter of said circular plate.

11. A device in accordance with claim 6, wherein:

an outer circumference of said rotor is simultaneously a pulley for a drive of said circular plate.

12. A device in accordance with claim 6, wherein:

a brake disc with a mechanical brake fixed to said rotor.

* * * * *